United States Patent [19]

Vetten

[11] 4,030,616

[45] June 21, 1977

[54] DEVICE FOR THE REMOVAL OF EMPTY CONTAINERS FROM THEIR MANDRELS

[75] Inventor: Wilhelm Vetten, Dusseldorf, Germany

[73] Assignee: Jagenberg-Werke AG, Dusseldorf, Germany

[22] Filed: Apr. 8, 1976

[21] Appl. No.: 674,997

[30] Foreign Application Priority Data

May 7, 1975 Germany ..... 2520504

[52] U.S. Cl. ..... 214/1 BB; 198/484; 214/1 BD; 242/81

[51] Int. Cl.[2] ..... B66C 1/66

[58] Field of Search ..... 214/1 BC, 1 BD, 151, 214/1 BB, 147 T, 1 B; 198/484, 796; 242/81; 221/272

[56] References Cited

UNITED STATES PATENTS

| | | | |
|---|---|---|---|
| 3,240,356 | 3/1966 | Hill | 214/1 BD |
| 3,737,050 | 6/1973 | Leeuwestein | 214/1 BD X |

*Primary Examiner*—L. J. Pasperner

*Assistant Examiner*—George F. Abraham

*Attorney, Agent, or Firm*—Burgess, Dinklage & Sprung

[57] ABSTRACT

In a device for stripping empty containers from a plurality of mandrels associated with a mandrel wheel and comprising a mandrel wheel, a plurality of mandrels projecting radially from said wheel, means for rotating said wheel and said mandrels, and radially displaceable means for stripping empty containers from said mandrels, the improvement which comprises supporting means carried by said wheel in association with each mandrel and of such size that upon rotation of said wheel said stripping means contacts the supporting means of the next mandrel before it ceases to contact the supporting means of the immediately preceding mandrel, whereby the stripping means is always positively supported. Advantageously each supporting means is integral with a face of a respective mandrel which is perpendicular to the axis of rotation of the mandrel wheel and each stripping means comprises a pair of flat plates resiliently urged against opposite faces of a mandrel and reciprocated therealong radially relative to the axis of rotation of the mandrel wheel.

8 Claims, 2 Drawing Figures

DEVICE FOR THE REMOVAL OF EMPTY CONTAINERS FROM THEIR MANDRELS

BACKGROUND

The invention relates to a device for stripping empty containers from the mandrels of a mandrel wheel.

It is known to strip empty containers from the mandrels of a mandrel wheel by means of two confronting hooks which are driven in grooves in a mandrel wheel by a chain circulating constantly in one direction. The hooks engage the edge of the container only point-wise, so that they can easily damage the edge. Furthermore, the hooks have to be guided very precisely so that they will always enter into the grooves in the mandrels.

THE INVENTION

It is the object of the invention to improve a device of the kind described above, so that the stripping means will always grip the container securely and gently.

This object is achieved by the invention in that supporting surfaces narrowing the gaps between the mandrels are provided at the end face of the mandrel wheel and lie in the same plane as the adjacent lateral surfaces of the mandrels, and at least one radially driven stripper is provided which lies against the lateral surfaces of the mandrels and against the supporting surfaces during the rotation of the mandrel wheel.

Alternatively, the object can also be achieved by providing at least one radially driven stripper which engages the lateral surfaces of the mandrels and is of such a size that, when the mandrel wheel rotates, it will engage the lateral surface of an adjacent mandrel before leaving the lateral surface of the one on which it is lying.

In both of the solutions proposed by the invention, the stripper is always in engagement with the mandrel wheel, and consequently engages it even while the mandrel wheel is rotating. In this manner a secure and uncomplicated. guidance of the stripper is achieved, since the stripper slides from one mandrel onto the next while the mandrel wheel is rotating beneath it. If the mandrels are placed closely together on the mandrel sheel, and if the stripper is of an appropriate size, the stripper will be able to reach the second mandrel before it has left the first, while in the case of a greater distance between the mandrels, it is desirable to provide between the mandrels a supporting surface in the same plane as the lateral surfaces of the mandrels.

In one embodiment, the invention proposes that the supporting surface be formed by a face of the mandrel that is perpendicular to the axis of the mandrel wheel. It is furthermore proposed that the stripper be a flat plate which can be urged flatly against the surfaces by resilient means, thereby achieving a very reliable engagement between the plate and the surfaces on which it lies. Preferably, the stripper can be reciprocated radially of the mandrel wheel by a transport means.

To prevent damage to the edge of the container, the stripper should be of such a size that it will engage the end of the container over the entire width of the latter. Furthermore, one stripper should be provided on each side of the mandrel wheel to prevent unbalanced pressure against the edges of the container causing it to jam.

An embodiment of the invention is represented in the drawing and will now be further described.

Figure 1:
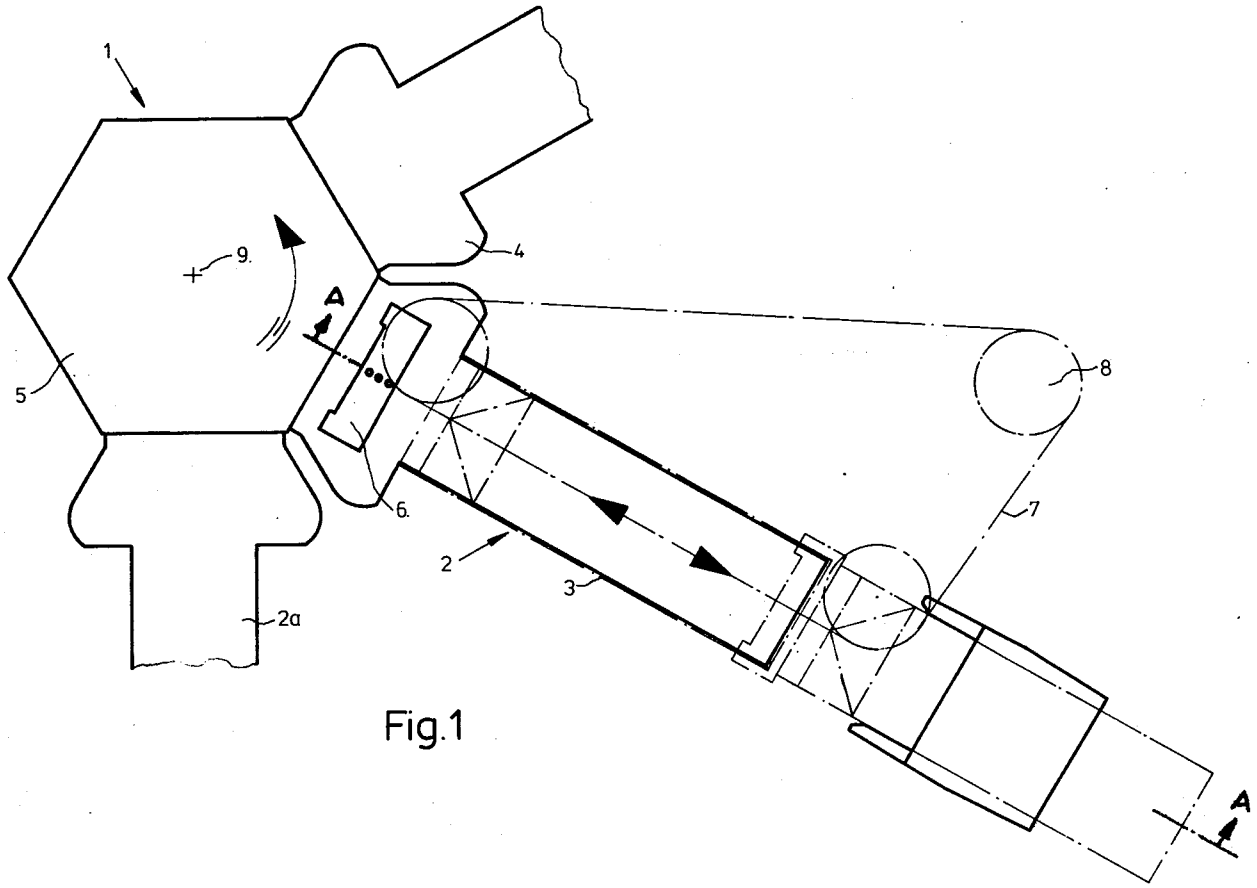
FIG. 1 is a side elevational fragmentary view of the mandrel wheel.
Figure 2:
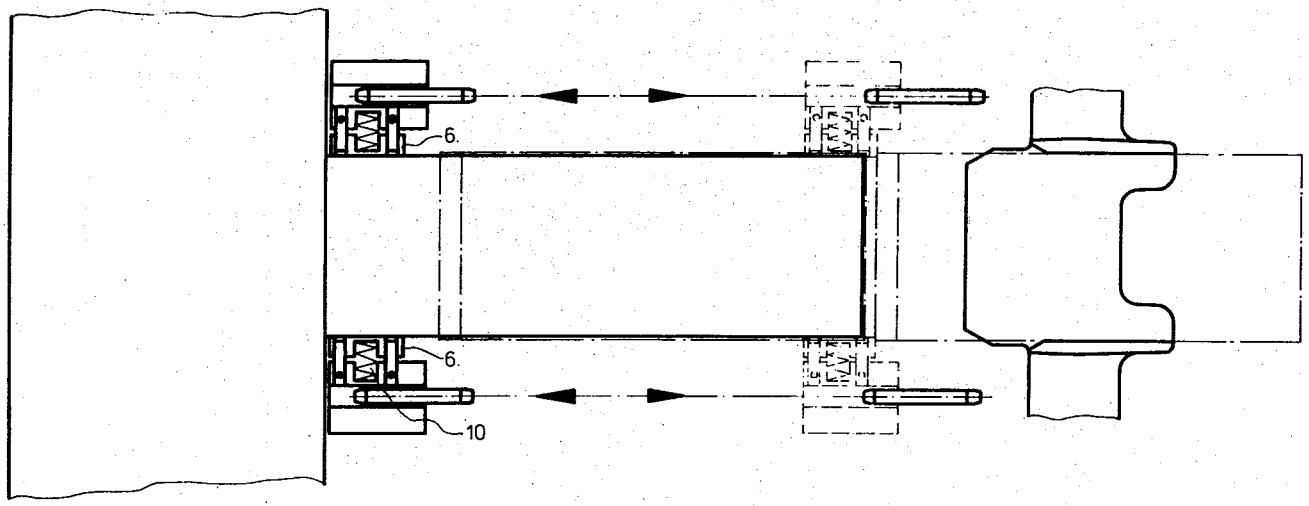
FIG. 2 is a cross sectional view of a mandrel taken along line A—A of FIG. 1.

A mandrel wheel 1 which is rotatable about an axis 9 has six mandrels 2 and moves in a certain cyclical sequence of 60° steps. A rectangular, folding container which is open at both ends is placed over the mandrel that is pointing upwardly in each case, and its bottom is closed by folding on the mandrel wheel. At the station of the mandrel which is concerned by this invention, the container 3 is being stripped from the mandrel wheel 1. For this purpose one stripper 6 is provided on both faces of the mandrel wheel 1, and consists of a rectangular piece of flat steel whose broad side is engaged with the lateral surface 2*a* of the mandrel 2 which is located beneath it. Each stripper 6 is fastened to a chain 7 which is guided over three sprockets 8. A secure engagement of the stripper 6 with the surfaces is achieved by means of two springs 10.

The chain 7 is driven by a crank drive and reciprocates the stripper 6 which, in its movement towards the outer extremity of the mandrel, fully engages the edge of one sidewall of the container 3 and thus pushes off the container. In its position at the foot of the mandrel, the stripper 6 lies wholly or partially on a supporting surface 4 which is formed by the mandrel or by the face of the mandrel wheel and is located in the same plane as the lateral surfaces 2*a* of the mandrels.

While the stripper 6 is in its starting position, the mandrel wheel 1 rotates beneath it, while the stripper slides on the supporting surfaces 4 and thus reaches the lateral surface 2*a* of the next mandrel without having to be lifted up. In the event that the mandrels 2 are placed relatively closely together and/or the stripper 6 is sufficiently large, the supporting surfaces 4 can be dispensed with, since then the stripper 6 will reach the next mandrel before it has left the one on which it is lying.

It will be appreciated that the instant specification and examples are set forth by way of illustration and not limitation, and that various modifications and changes may be made without departing from the spirit and scope of the present invention.

What is claimed is:

1. In a device for stripping empty containers from a plurality of mandrels associated with a mandrel wheel and comprising a mandrel wheel, a plurality of mandrels projecting radially from said wheel, means for rotating said wheel and said mandrels, and radially displaceable means for stripping empty containers from said mandrels, the improvement which comprises supporting means carried by said wheel in association with each mandrel and of such size that upon rotation of said wheel said stripping means contacts the supporting means of the next mandrel before it ceases to contact the supporting means of the immediately preceding mandrel, whereby the stripping means is always positively supported.

2. A device according to claim 1, wherein each supporting means is integral with a face of a respective mandrel which is perpendicular to the axis of rotation of the mandrel wheel.

3. A device according to claim 1, wherein said stripping means includes a flat stripper plate which is of such width that is engages an end of a container to be stripped across the full width of such end.

4. A device according to claim 1, wherein said stripping means includes a pair of strippers operating on opposite surfaces of each mandrel and thus on opposite sides of an empty container thereon.

5. A device according to claim 1, wherein said stripping means includes a flat stripper plate, and means resiliently urging said plate against said face.

6. A device according to claim 5, wherein said stripping means further includes means for slidably reciprocating said plate along a face of its mandrel radially relative to the axis of rotation of the mandrel wheel.

7. A device according to claim 6, wherein said plate in its foremost reciprocated position still has at least a portion of its surface in contact with the face of its mandrel.

8. A device according to claim 7, wherein said stripping means includes a pair of strippers operating on opposite surfaces of each mandrel and thus on opposite sides of an empty container thereon, each of said stripper plates being of such width that it engages an end of a container to be stripped across the full width of such end, each supporting means being integral with a face of a respective mandrel which is perpendicular to the axis of rotation of the mandrel wheel.

* * * * *